US008770157B2

(12) United States Patent
Yano et al.

(10) Patent No.: US 8,770,157 B2
(45) Date of Patent: Jul. 8, 2014

(54) CYLINDER COOLING APPARATUS FOR AIR-COOLED ENGINE

(75) Inventors: Takahiro Yano, Kakogawa (JP); Michio Hirano, Akashi (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 151 days.

(21) Appl. No.: 13/241,917

(22) Filed: Sep. 23, 2011

(65) Prior Publication Data

US 2012/0097119 A1 Apr. 26, 2012

(30) Foreign Application Priority Data

Oct. 26, 2010 (JP) ..... P2010-239613

(51) Int. Cl.
*F01P 7/04* (2006.01)

(52) U.S. Cl.
USPC ..... 123/41.65; 123/41.27; 123/41.54; 123/41.56

(58) Field of Classification Search
USPC ..... 123/41.63, 41.01, 41.11, 41.22, 41.49, 123/41.54, 41.56, 41.62, 41.65, 41.86
See application file for complete search history.

(56) References Cited

U.S. PATENT DOCUMENTS

| | | | | |
|---|---|---|---|---|
| 4,825,816 | A * | 5/1989 | Yamada et al. | 123/41.57 |
| 5,000,126 | A * | 3/1991 | Isaka et al. | 123/41.65 |
| 5,606,944 | A * | 3/1997 | Kurihara | 123/90.31 |
| 8,171,898 | B2 * | 5/2012 | Nagenkogl et al. | 123/41.72 |
| 2004/0031458 | A1 * | 2/2004 | Snyder et al. | 123/90.31 |
| 2005/0150474 | A1 * | 7/2005 | Snyder et al. | 123/90.31 |
| 2005/0279318 | A1 * | 12/2005 | Nagel et al. | 123/196 R |
| 2008/0257630 | A1 * | 10/2008 | Takeshima et al. | 180/248 |
| 2009/0301413 | A1 * | 12/2009 | Ogawa et al. | 123/41.48 |

FOREIGN PATENT DOCUMENTS

| | | |
|---|---|---|
| JP | 63-126542 | 8/1988 |
| JP | 5-32752 | 4/1993 |
| JP | 6-42347 | 2/1994 |
| JP | 7-293238 | 11/1995 |
| JP | 10-227254 | 8/1998 |
| JP | 11-280543 | 10/1999 |
| JP | 2000-88057 | 3/2000 |
| JP | 2001082245 A * | 3/2001 |

OTHER PUBLICATIONS

Machine translation of JP 2001082245 A, Mar. 2001, "JP2001082245A_translation.pdf".*

* cited by examiner

*Primary Examiner* — Noah Kamen
*Assistant Examiner* — Long T Tran
(74) *Attorney, Agent, or Firm* — Wenderoth, Lind & Ponack, L.L.P.

(57) ABSTRACT

A cylinder cooling apparatus for an air-cooled engine is equipped with a cooling fan provided on one end section of a crankshaft; a pair of pushrod insertion holes for air intake and exhaust valves formed in a cylinder outer circumferential wall section; a fan shroud for covering the cooling fan and for covering the cylinder outer circumferential wall section in which the pushrod insertion holes are formed; a cutout ventilating section formed in the cylinder outer circumferential wall section between the pair of pushrod insertion holes; and tunnel-shaped ventilating holes formed in the cylinder outer circumferential wall section between the pushrod insertion hole disposed on the side of the cooling fan and a cylinder bore and extending from the cylinder outer circumferential wall section on the side of the cooling fan to the cutout ventilating section.

14 Claims, 7 Drawing Sheets

CYLINDER COOLING APPARATUS FOR AIR-COOLED ENGINE

BACKGROUND OF THE INVENTION

1. Field of the Invention

The present invention relates to a cylinder cooling apparatus for an air-cooled engine, wherein cooling air from a cooling fan cools the cylinder of the engine.

2. Description of the Related Art

As disclosed, for example, in Japanese Patent Application Laid-Open Publication No. Hei 10-227254 (Conventional technology 1), Japanese Patent Application Laid-Open Publication No. Hei 06-42347 (Conventional technology 2), and Japanese Patent Application Laid-Open Publication No. Hei 07-293238 (Conventional technology 3), various proposals are made in which a cooling air passage for guiding the cooling air from a cooling fan to a cylinder and a cylinder head is formed into an appropriate shape so that a cylinder and a cylinder head being high in temperature are cooled uniformly as much as possible.

Furthermore, a cylinder-inclined overhead valve engine in which its cylinder is inclined so that the total height of the engine is suppressed low is disclosed in Patent document 4. In this cylinder-inclined overhead valve engine, the cams on a camshaft disposed below the cylinder rock the rocker arms disposed above the cylinder via tappets and pushrods, whereby the air intake and exhaust valves disposed in the cylinder head are moved up and down. The tappets and the pushrods are disposed on the lower side of the inclined cylinder. When the inclined cylinder is viewed from the crankshaft of the engine, only a cylinder outer circumferential wall section is present on the upper side of the inclined cylinder. Hence, the thickness of the cylinder outer circumferential wall section on the upper side is not particularly large. On the other hand, the pushrods, etc. are present on the lower side of the inclined cylinder. Hence, the thickness of the cylinder outer circumferential wall section on the lower side is large. For this reason, when the inclined cylinder is viewed from the crankshaft of the engine, the configuration of the cylinder and the thickness of the cylinder outer circumferential wall section on the upper side are greatly different from those on the lower side.

Problem to be Solved by the Invention

In the cylinder-inclined overhead valve engine disclosed in Japanese Patent Application Laid-Open Publication No. 2008-88057 (Conventional technology 4), a cooling air passage is formed so that the cooling air from a cooling fan flows along the outer circumferential surface of the cylinder of the engine in a direction opposite to the side of the cooling fan. However, since the thickness of the cylinder outer circumferential wall section on the lower side of the cylinder in which the pushrods, etc. are disposed is large, the effect of cooling the cylinder using the cooling air is not exerted sufficiently inside the cylinder.

Accordingly, a technical problem to be solved by the present invention is to provide a cylinder cooling apparatus for an air-cooled engine, capable of efficiently exerting the cooling effect of cooling air from a cooling fan on the inside of the cylinder of the engine even if the outer circumferential wall section of the cylinder is thick.

SUMMARY OF THE INVENTION

In order to solve the foregoing technical problem, the present invention provides a cylinder cooling apparatus for an air-cooled engine described below.

In order to solve the above-mentioned problem, a cylinder cooling apparatus for an air-cooled engine according to an embodiment of the present invention is equipped with a cooling fan provided on one end section of a crankshaft; a pair of pushrod insertion holes for air intake and exhaust valves formed in a cylinder outer circumferential wall section on the side approximately orthogonal to the axial direction of the crankshaft and disposed with a space provided therebetween in the axial direction of the crankshaft; a fan shroud for covering the cooling fan and for covering the cylinder outer circumferential wall section in which the pushrod insertion holes are formed; a cutout ventilating section formed in the cylinder outer circumferential wall section between the pair of pushrod insertion holes; and tunnel-shaped ventilating holes formed in the cylinder outer circumferential wall section between the pushrod insertion hole disposed on the side of the cooling fan and a cylinder bore and extending from the cylinder outer circumferential wall section on the side of the cooling fan to the cutout ventilating section.

With the above-mentioned configuration, the cooling air from the cooling fan flows into the cylinder outer circumferential wall section, the thickness of which is made large due to the formation of the pushrod insertion holes. As a result, the cooling effect by the cooling air can be exerted efficiently to the inside of the cylinder, and the cylinder and the cylinder head being high in temperature can be cooled uniformly as much as possible. In addition, since the cooling fan is not required to be made large in size, the outside dimensions of the engine is not required to be changed and the engine can be made compact.

It is preferable that the axial center of the cylinder is inclined approximately with respect to the vertical direction.

With the above-mentioned configuration, the total height of the engine can be suppressed low.

It is preferable that the pushrod insertion hole disposed on the side of the cooling fan is used for the air intake valve.

With the above-mentioned configuration, the fuel supply apparatus is disposed on the side of the cooling fan, whereby the fuel supply apparatus (carburetor) can be cooled effectively by using cooling air being low in temperature and not yet used to cool the cylinder.

It is preferable that the cylinder cooling apparatus is further equipped with a tunnel-shaped ventilating hole formed in the cylinder outer circumferential wall section between the pushrod insertion hole disposed on the opposite side of the cooling fan and the cylinder bore and extending from the cutout ventilating section to the cylinder outer circumferential wall section on the opposite side of the cooling fan.

With the above-mentioned configuration, the cooling air also flows into the cylinder outer circumferential wall section on the opposite side of the cooling fan, whereby the cylinder can be cooled more uniformly.

It is preferable that the tunnel-shaped ventilating hole is formed into a plurality of small ventilating holes disposed so as to be arranged in the axial direction of the cylinder.

With the above-mentioned configuration, the mechanical strength of the portions around the tunnel-shaped ventilating holes can be avoided from being lowered.

PREFERRED EMBODIMENTS

An embodiment of a forced-air-cooled cylinder-inclined overhead valve engine having a cylinder cooling apparatus according to the present invention will be described below in detail referring to FIGS. 1 to 7.

(Configuration of Entire Engine)

Figure 1:
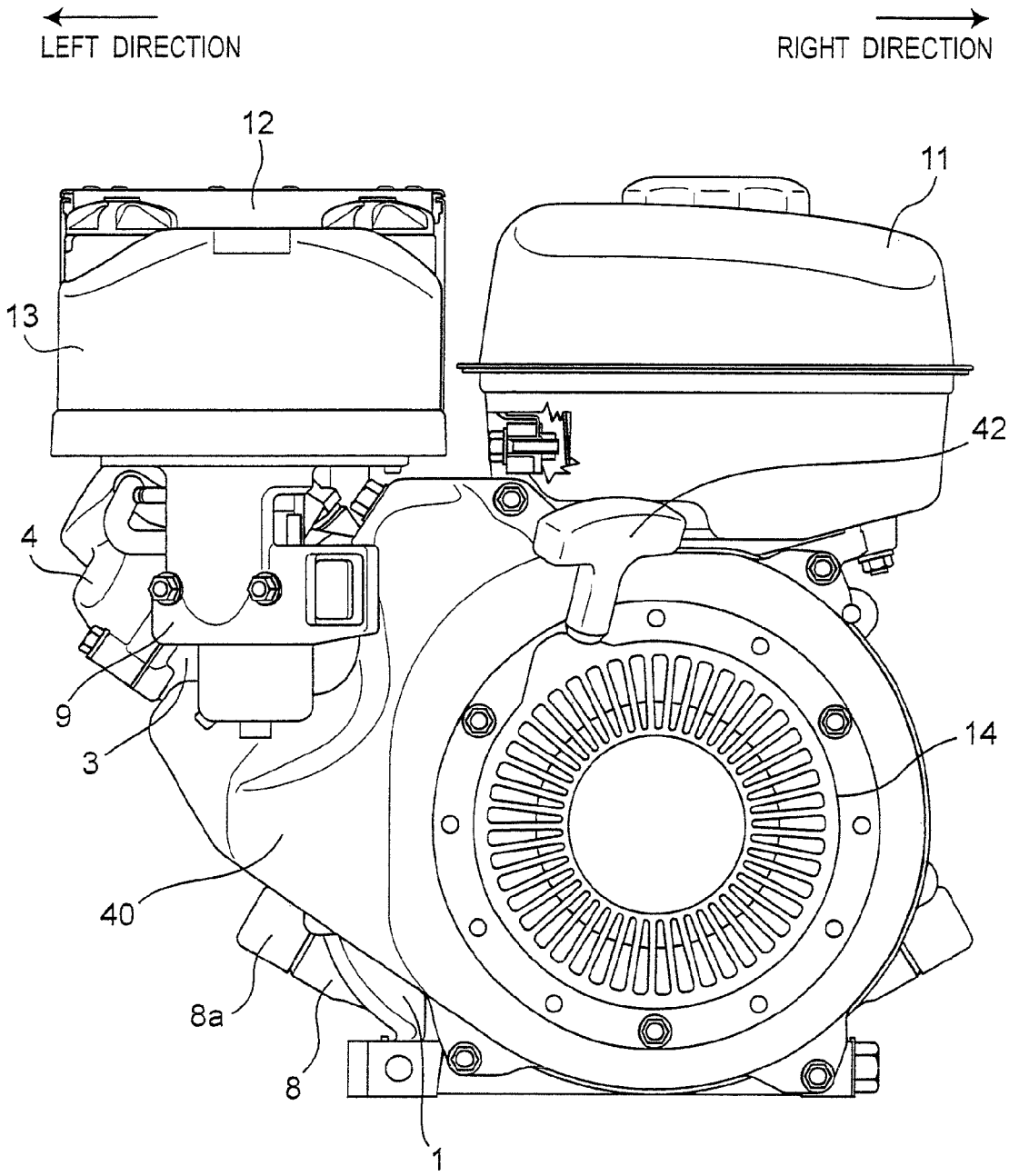
FIG. 1 is a rear view showing an embodiment of an air-cooled engine having a cylinder cooling apparatus according to the present invention.

FIG. 1 is a rear view showing a forced-air-cooled cylinder-inclined overhead valve engine, seen in the axial direction of a crankshaft 5. For the convenience of description, the side of the output shaft section of the crankshaft 5 in the axial direction of the crankshaft 5 is referred to as the "forward direction" of the engine, the side of the cooling fan 44 of the crankshaft 5 in the axial direction of the crankshaft 5 is referred to as the "rearward direction" of the engine; furthermore, the side which is nearly orthogonal to the crankshaft 5 and on which a cylinder 2 is inclined is referred to as the "left direction" of the engine, and the opposite side thereof is referred to as the "right direction" of the engine.

The engine shown in FIG. 1 is equipped with a fan shroud 40 covering an engine body and fastened to a crankcase 1 with a plurality of bolts; a recoil starter 14 installed on the rear end section of the crankshaft 5; a grip 42 for operating the recoil starter 14; a fuel tank 11 disposed on the upper right side of the fan shroud 40; an exhaust muffler 12 disposed on the upper left side and the forward side of the fan shroud 40; and an air cleaner 13 disposed on the upper left side and the rearward side of the fan shroud 40. Numeral 3 in FIG. 1 designates a cylinder head, numeral 4 designates a cylinder head cover, numeral 8 designates an oil gauge installation section, numeral 8*a* designates an oil gauge, and numeral 9 designates a fuel supply apparatus (carburetor).

Figure 2:
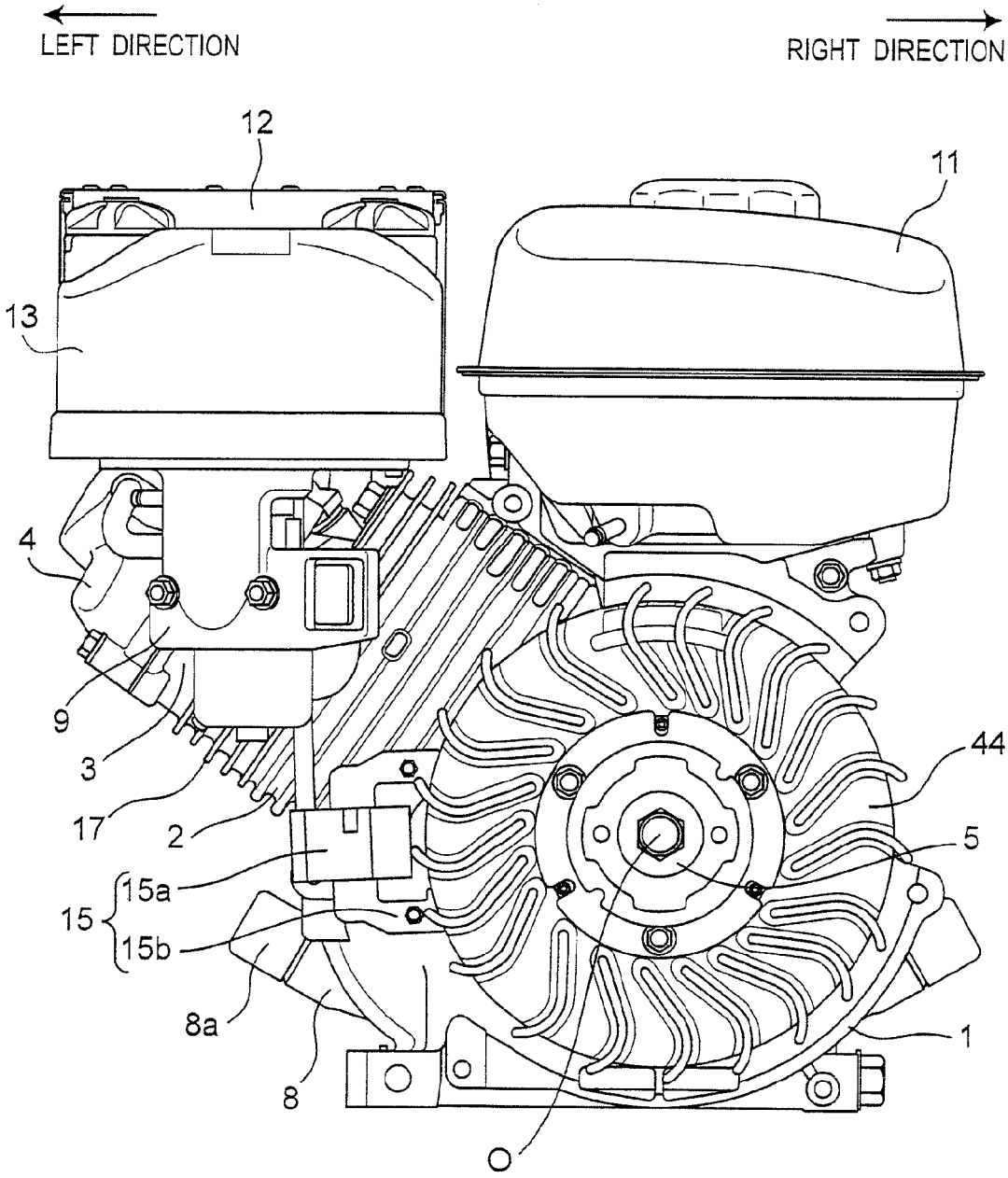
FIG. 2 is a rear view showing a state in which a recoil starter and a fan shroud are removed from the air-cooled engine shown in FIG. 1.

FIG. 2 is a rear view showing a state in which the recoil starter 14 and the fan shroud 40 are removed from the engine shown in FIG. 1. In FIG. 2, the engine body has a configuration in which the cylinder 2 and the crankcase 1 are integrated on the upper face of the left side section of the crankcase 1, and the cylinder head 3 and the cylinder head cover 4 are fastened to the cylinder 2 in this order. The axial center line of the cylinder 2 is inclined in the left direction by a predetermined angle (for example, an inclination angle of 55 to 60 degrees) with respect to the vertical line passing through the shaft center O of the crankshaft 5 being nearly horizontal. Since the cylinder 2 is inclined, the total height of the engine can be suppressed low. The forward end section of the crankshaft 5, i.e., the output shaft section thereof, protrudes from a crankcase cover (not shown) to the outside. The cooling fan 44 and a flywheel (not shown) are installed on the rear end section of the crankshaft 5 so as to be rotatable integrally. The downstream end of the fuel supply apparatus 9 is connected to the air inlet port 20 (shown in FIG. 6) of the cylinder head 3. An ignition unit 15 for driving an ignition plug (not shown) is disposed under the fuel supply apparatus 9 and near the left fringe section of the cooling fan 44. The ignition unit 15 is equipped with an ignition coil 15*a* and a magnetic unit 15*b*. Since the fuel supply apparatus 9 is disposed on the side of the cooling fan 44, the fuel supply apparatus (carburetor) 9 can be cooled effectively by using cooling air being low in temperature and not yet used to cool the cylinder 2.

Figure 3:
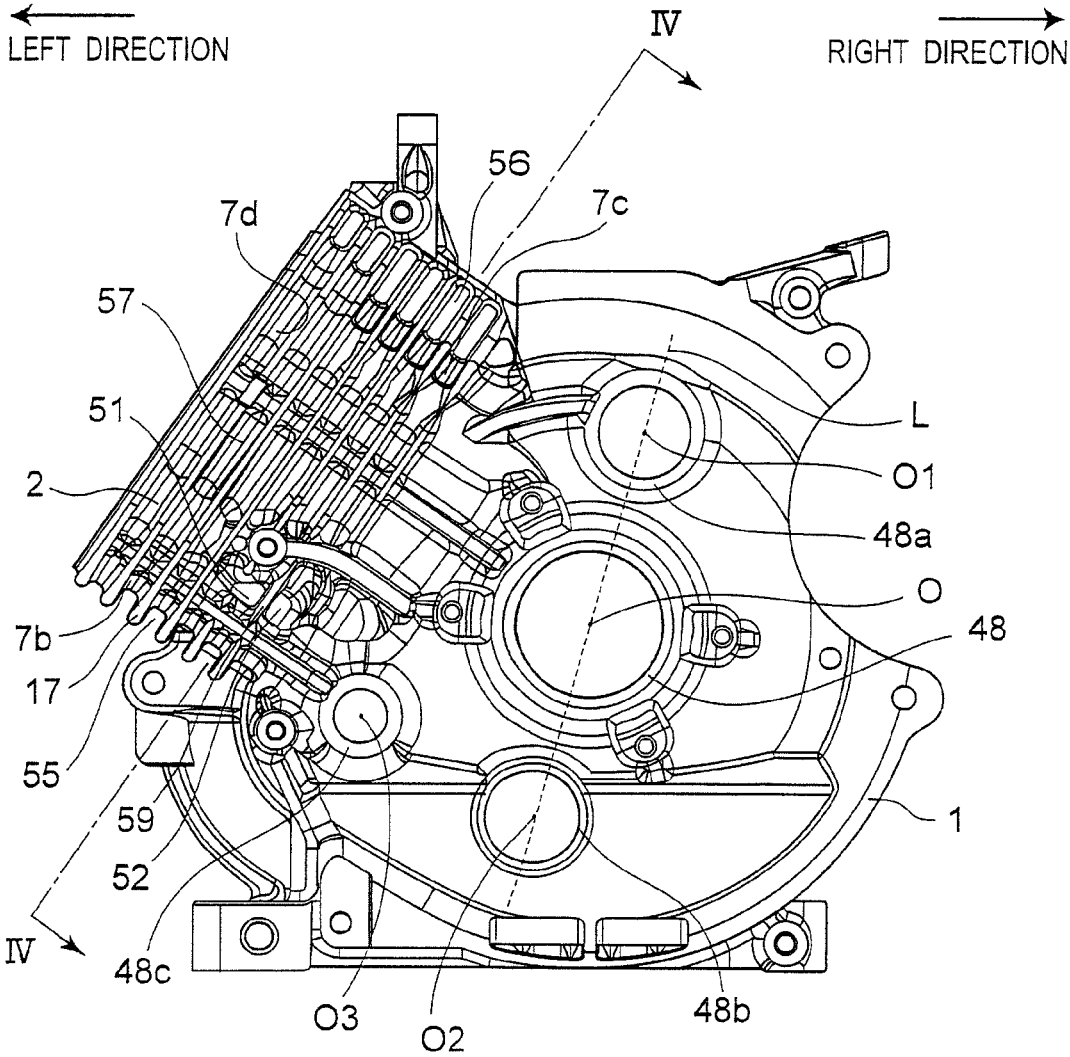
FIG. 3 is a rear view showing the main sections of the cylinder and the crankcase of the air-cooled engine shown in FIG. 2.

FIG. 3 is a rear view showing the main sections of the cylinder 2 and the crankcase 1 of the engine shown in FIG. 2. Referring to FIG. 3, inside the crankcase 1, concave sections are formed to accommodate bearings for supporting the crankshaft (not shown), a first balancer shaft on the upper side, a second balancer shaft on the lower side, an air intake and exhaust valve drive camshaft (these shafts are not shown) so that these shafts are respectively rotatable in nearly parallel with the crankshaft. More specifically, a large concave section 48 formed at the central section of the crankcase 1 is used for the crankshaft, a concave section 48*a* formed on the upper right side is used for the first balancer shaft, a concave section 48*b* formed on the lower left side is used for the second balancer shaft, and a small concave section 48*c* formed on the lower left side and near the cylinder 2 is used for the camshaft. The first balancer shaft and the second balancer shaft are disposed so that a phase difference of approximately 180 degrees is provided between the shaft center O1 of the first balancer shaft and the shaft center O2 of the second balancer shaft around the shaft center O of the crankshaft 5. In other words, as seen in the axial direction of the crankshaft, the shaft center O of the crankshaft and the shaft centers O1 and O2 of both the balancer shafts are positioned on an approximately straight line L. In this case, the straight line L along which the three shaft centers O, O1 and O2 are arranged is inclined clockwise by a predetermined angle (for example, an inclination angle of 19 degrees) from a straight line nearly orthogonal to the axial center line of the cylinder 2. Hence, the shaft center O1 of the first balancer shaft and the shaft center O2 of the second balancer shaft are set so as to approach an approximately vertical line passing through the shaft center O of the crankshaft 5 in the left-right direction.

(Overhead Valve Structure of Engine)

The engine having the cylinder cooling apparatus according to the present invention is a cylinder-inclined type in which the cylinder 2 is inclined left-downward with respect to the vertical direction and is an overhead valve (OHV) type in which air intake and exhaust valves (not shown) are disposed above the head of the cylinder 2 and push rods 33 (shown in FIG. 6) for driving the air intake and exhaust valves are disposed in the side wall section of the cylinder 2. The overhead valve structure of the engine will be described below referring to FIGS. 5, 6 and 7.

Figure 4:
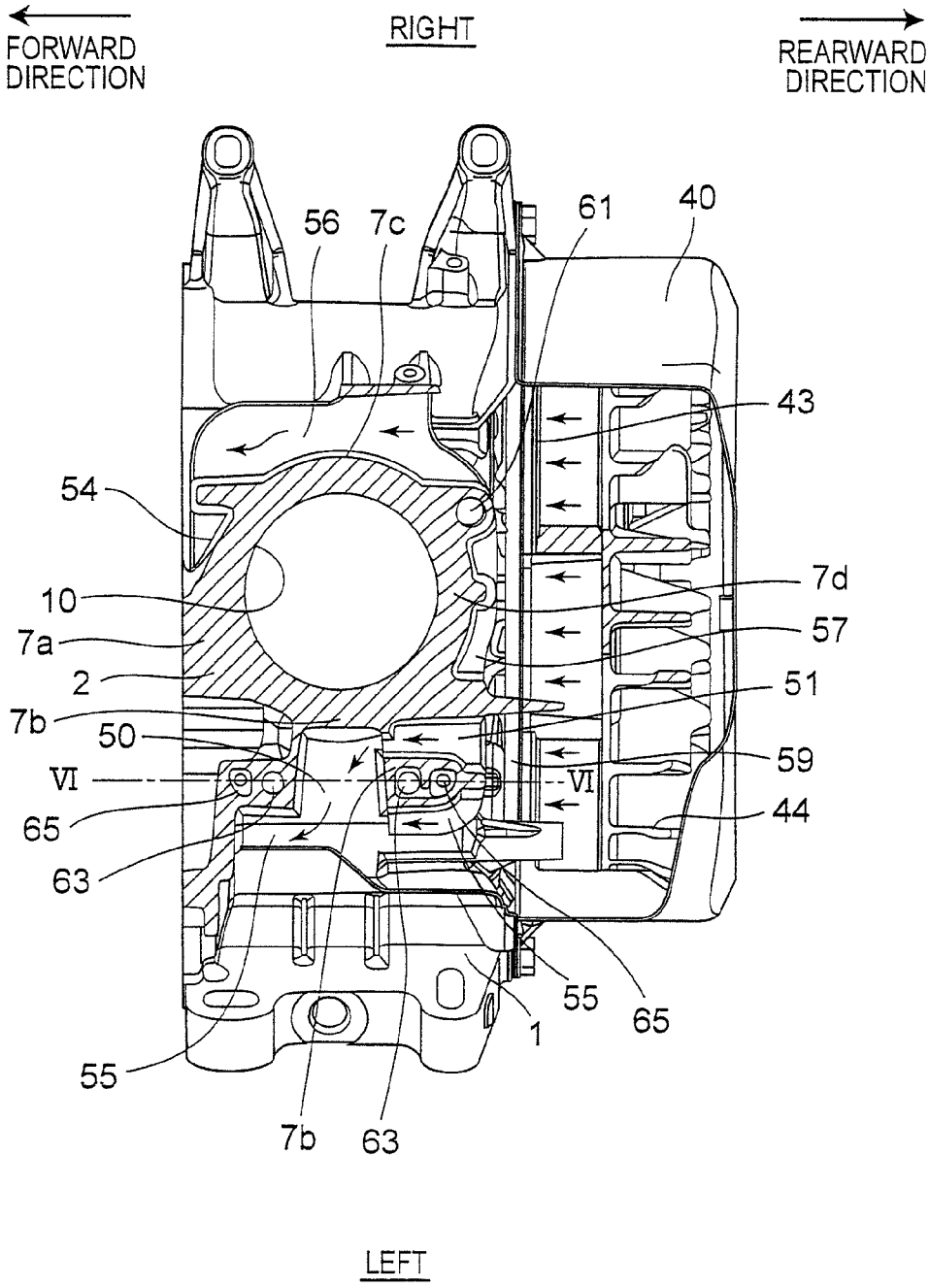
FIG. 4 is a sectional view taken on line IV-IV of FIG. 3, the cooling fan and the fan shroud of the engine being added.
Figure 5:
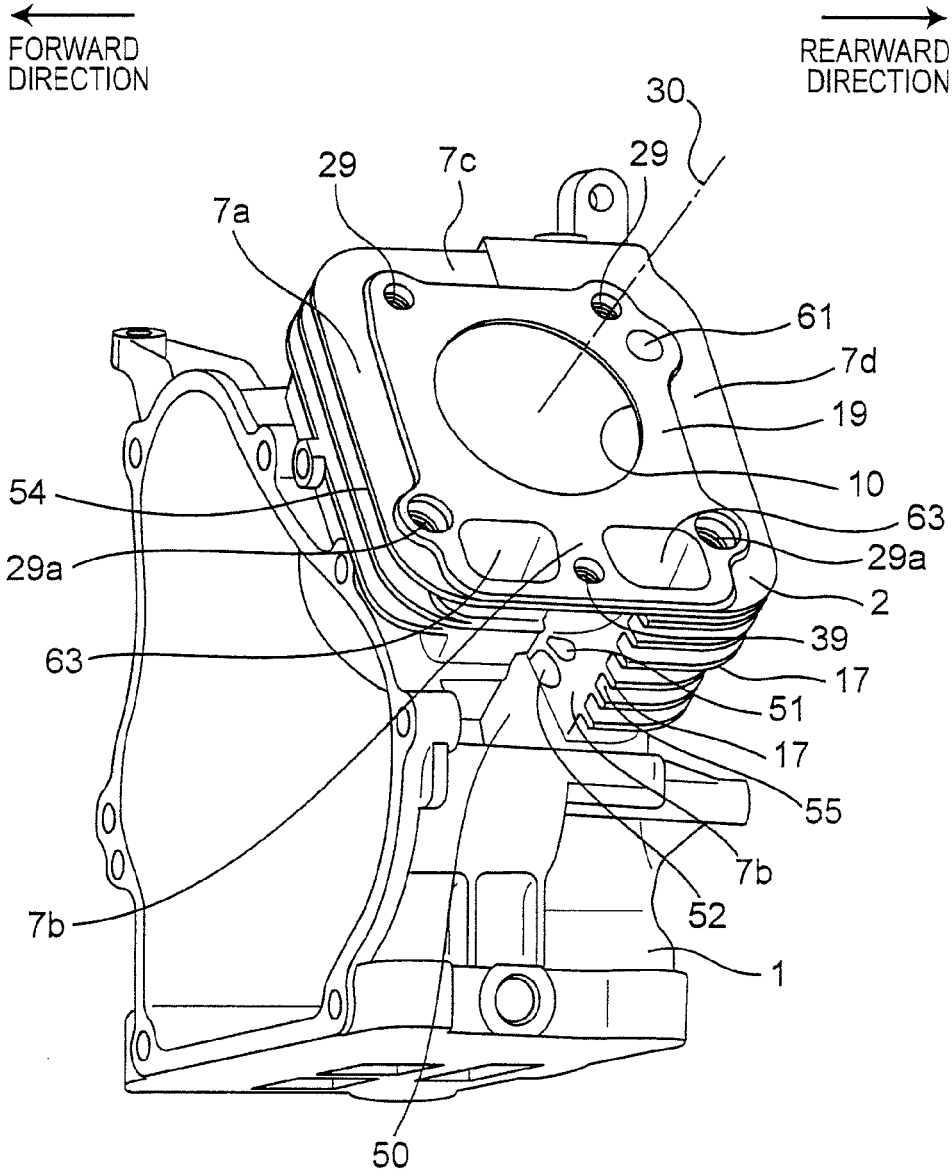
FIG. 5 is a perspective view showing the main sections of the cylinder and the crankcase shown in FIG. 3, seen from the diagonally front side.
Figure 6:
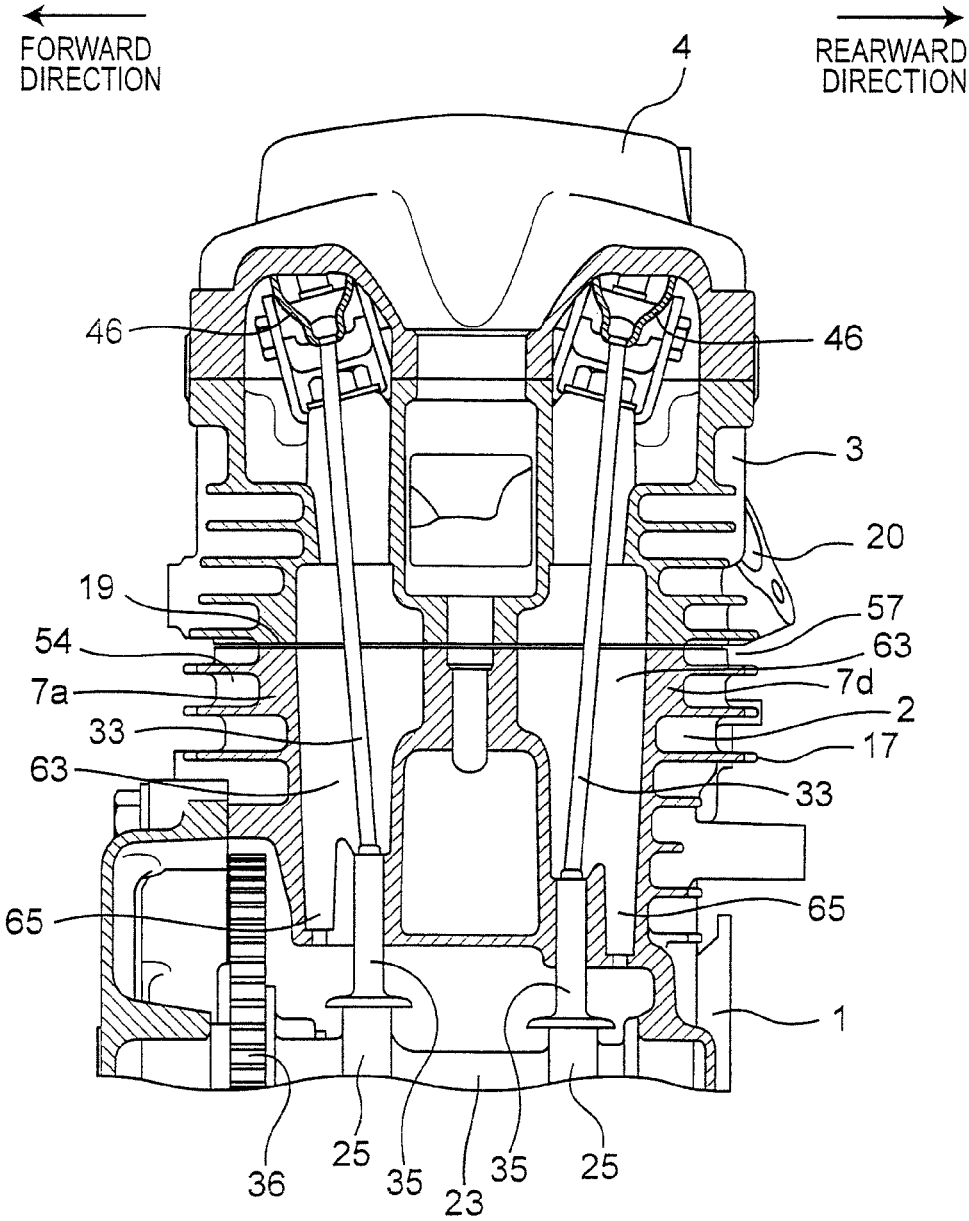
FIG. 6 is a sectional enlarged view in which part of the VI-VI section of FIG. 4 is enlarged.

FIG. 5 is a perspective view showing the main sections of the cylinder 2 and the crankcase 1 shown in FIG. 3, seen from the diagonally front side (that is, the diagonally forward side). FIG. 6 is a sectional enlarged view in which part of the VI-VI section of FIG. 4 is enlarged so that the valve drive structure of the overhead valve engine is clearly understood. Furthermore, FIG. 7 is a plan view showing a state in which the cylinder head cover 4 is removed from the cylinder head 3 shown in FIG. 6.

FIG. 5 shows the crankcase 1 and the cylinder 2 in a state in which the crankcase cover (not shown) mounted on the forward face of the crankcase 1 is removed. As shown in FIG. 5, the outer circumferential wall section of the cylinder 2 is formed of four cylinder outer circumferential wall sections: a cylinder outer circumferential wall section 7*a* on the forward side, a cylinder outer circumferential wall section 7*b* on the lower left side, a cylinder outer circumferential wall section 7*c* on the upper right side, and a cylinder outer circumferential wall section 7*d* on the rearward side. The lower side portions of a pair of pushrod insertion holes 63 are formed in the cylinder outer circumferential wall section 7*b* on the lower left side so as to be away from each other in the front-rear direction. The thickness of the cylinder outer circumferential wall section 7*b* on the lower left side is made larger than those of the other cylinder outer circumferential wall sections 7*a*, 7*c* and 7*d* to securely obtain spaces for the pair of pushrod insertion holes 63. Furthermore, the upper side portions of the pair of pushrod insertion holes 63 are formed in the cylinder head 3 (shown in FIG. 6) so as to be away from each other in the front-rear direction. Moreover, an oil supply hole 61 is formed near an upper female screw hole 29 on the rear right side. Oil in mist form is supplied to rocker arms 46 (shown in FIG. 6), the air intake and exhaust valves (not shown), etc. through the oil supply hole 61 to lubricate them. The oil supplied to the rocker arms 46 (shown in FIG. 6), etc. flows into the pair of pushrod insertion holes 63, passes through oil return holes 65 shown in FIG. 6 from the lower portions of the pushrod insertion holes 63 and is returned to an oil pan (not shown) disposed in the lower section of the crankcase 1.

As shown in FIG. 6, a pair of pushrods 33 for driving the air intake and exhaust valves (not shown) supported on the cylinder head 3 is disposed in the pair of pushrod insertion holes 63. The lower end faces of the pair of pushrods 33 respectively make contact with the cams 25 of the camshaft 23 via tappets 35. The pushrods 33 are moved up and down in their axial directions by the cams 25.

Figure 7:
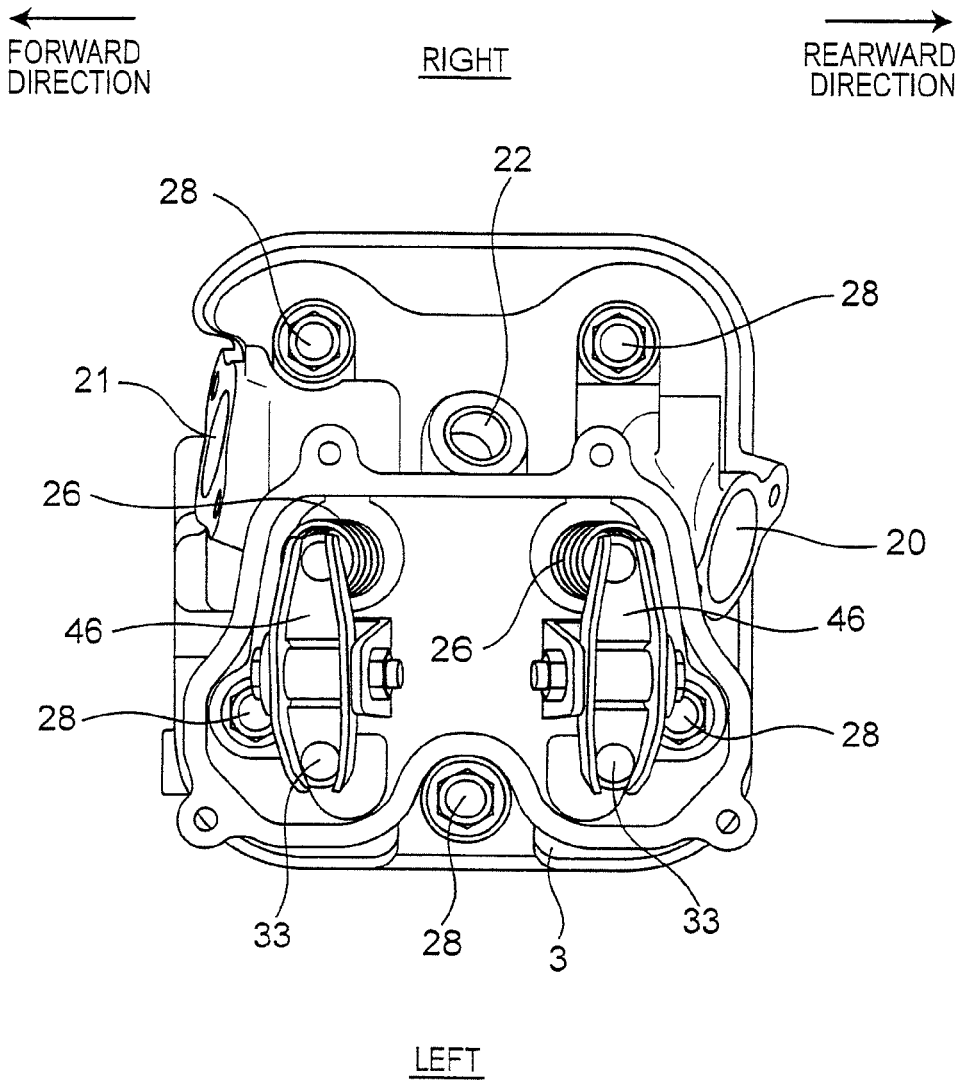
FIG. 7 is a plan view showing a state in which a cylinder head cover is removed from the engine shown in FIG. 6.

As shown in FIG. 7, each of the pair of rocker arms 46 is rockably provided in the cylinder head 3, and each of the upper end sections of the pair of pushrods 33 is fitted in one end of each of the pair of rocker arms 46. Furthermore, each of the upper end sections of the air intake and exhaust valves (not shown) supported on the cylinder head 3 makes contact with the other end of each of the pair of the rocker arms 46 via a valve spring 26 biased in a valve closing direction. As shown in FIG. 6, the cam drive gear 36 of the camshaft 23 is engaged with the crank gear (not shown) of the crankshaft 5 (shown in FIG. 2) disposed in nearly parallel with the camshaft 23, and the camshaft 23 is connected to the crankshaft 5 (shown in FIG. 2) so that a reduction ratio of 2 is obtained. As a result, the camshaft 23 rotates so that the rotation speed thereof is half that of the crank shaft 5 (shown in FIG. 2), and the air intake and exhaust valves (not shown) are opened/closed at a predetermined timing. Moreover, returning to FIG. 7, an ignition plug installation opening 22 into which the ignition plug (not shown) is screw-engaged is provided in the upper face of the cylinder head 3. An exhaust port 21 and an air intake port 20 are provided on the forward side face and the rearward side face of the cylinder head 3, respectively. Since the air intake port 20 is provided on the rearward side face of the cylinder head 3, the pushrod insertion hole 63 disposed on the rearward side, that is, on the side of the cooling fan 44 (shown in FIG. 2), is used for the air intake valve.

As shown in FIG. 5, the corner sections on the side of the outer circumferential wall section 7*c* on the upper right side of the cylinder 2 are respectively provided with upper female screw holes 29 extending in nearly parallel with the axial center line 30 of the cylinder 2. The corner sections of the outer circumferential wall section 7*b* on the lower left side of the cylinder 2 are respectively provided with lower female screw holes 29*a* extending in nearly parallel with the axial center line 30 of the cylinder 2. The opening diameter of the lower female screw hole 29*a* is made larger than the opening diameter of the upper female screw hole 29 so that a positioning collar (not shown) is engaged with and inserted into the upper section of the lower female screw hole 29*a*. Furthermore, a central female screw hole 39 extending in nearly parallel with the axial center line 30 of the cylinder 2 is provided between the pair of pushrod insertion holes 63. As a result, five female screw holes 29, 29*a* and 39 are provided in the cylinder 2. The screw holes formed at the lower sections of the female screw holes 29, 29*a* and 39 are common, and the screws of installation bolts 28 are engaged with the screw holes. As shown in FIG. 6, the engine body is assembled as described below. While the cylinder head 3 is laid on the cylinder 2 with a gasket 19 held therebetween, the cylinder 2 is integrally connected to the cylinder head 3 by respectively screw-engaging the installation bolts 28 (shown in FIG. 7) with the two upper female screw holes 29 provided in the corner sections on the side of the outer circumferential wall section 7*c* on the upper right side of the cylinder 2, the two lower female screw holes 29*a* provided in the corner sections on the side of the outer circumferential wall section 7*b* on the lower left side of the cylinder 2, and the central female screw hole 39 provided between the pushrod insertion holes 63. Then, the cylinder head cover 4 is mounted on the cylinder head 3 with mounting bolts (not shown). As shown in FIG. 5, a piston (not shown) is slidably inserted into a cylinder bore 10 formed at the central section of the cylinder 2, and the piston is connected to the crankshaft 5 (shown in FIG. 2) via a connecting rod.

(Cooling Structure of Engine)

The above-mentioned cylinder-inclined overhead valve engine has the cylinder cooling apparatus according to the present invention, and the structure of the cylinder cooling apparatus will be described below referring to FIGS. 3, 4 and 5. FIG. 4 is a sectional view taken on line IV-IV of FIG. 3, the cooling fan 44 and the fan shroud 40 being added to the configuration shown in FIG. 3.

As shown in FIGS. 3 and 5, numerous cooling fins 17 are integrally formed respectively on the cylinder outer circumferential wall section 7*a* on the forward side of the cylinder 2, the cylinder outer circumferential wall section 7*b* on the lower left side thereof, the cylinder outer circumferential wall section 7*c* on the upper right side thereof, and the cylinder outer circumferential wall section 7*d* on the rearward side thereof. The numerous cooling fins 17 are formed to extend while being away from one another in a direction being nearly orthogonal to the axial center line 30 of the cylinder 2. The cylinder outer circumferential wall section 7*a* on the forward side, the cylinder outer circumferential wall section 7*b* on the lower left side, the cylinder outer circumferential wall section 7*c* on the upper right side, and the cylinder outer circumferential wall section 7*d* on the rearward side are respectively equipped with a plurality of ventilating concave sections 54, 55, 56 and 57, each of which is formed at the space portion between the two adjacent cooling fins 17.

A first ventilating through hole 51 and a second ventilating through hole 52, each having a tunnel shape and extending in the front-rear direction, are formed in the rearward portion of the cylinder outer circumferential wall section 7*b* on the lower left side of the cylinder 2. Since the pushrod insertion holes 63 for the air intake and exhaust valves, extending in the up-down direction, are provided in the rearward portion of the cylinder outer circumferential wall section 7*b* on the lower left side, the first ventilating through hole 51 and the second ventilating through hole 52 are formed at the space portion between the pushrod insertion hole 63 for the air intake valve and the cylinder bore 10 so as not to interfere with the pushrod insertion hole 63 for the air intake valve positioned on the side of the cooling fan 44 (shown in FIG. 2). The plurality of tunnel-shaped ventilating holes, i.e., the first ventilating through hole 51 and the second ventilating through hole 52, are disposed so as to be arranged vertically in the axial center direction of the cylinder 2. Since the tunnel-shaped ventilating holes are formed of a plurality of small ventilating holes 51 and 52, the mechanical strength at the portion around the tunnel-shaped ventilating holes can be avoided from being lowered.

As shown in FIGS. 4 and 5, a cutout ventilating section 50 being cut out partially is formed in the cylinder outer circumferential wall section 7*b* on the lower left side. The cutout ventilating section 50 is formed by cutting out the space portion between the pair of pushrod insertion holes 63 in the up-down direction so as not to interfere with the female screw hole 39. Furthermore, the cutout ventilating section 50 is cut in the right direction toward the cylinder bore 10 beyond the pushrod insertion holes 63 as shown in FIG. 4. In addition, the overall thickness of the cylinder outer circumferential wall section 7*b* on the lower left side is larger than those of the other cylinder outer circumferential wall sections 7*a*, 7*c* and 7*d*. However, the thickness of the cylinder outer circumferential wall section 7*b* on the lower left side at the cutout ventilating section 50 is approximately the same as the thickness of the other cylinder outer circumferential wall sections 7*a*, 7*c* and 7*d*.

As shown in FIGS. 4 and 5, the lower side portion of the cutout ventilating section 50 formed in the cylinder outer circumferential wall section 7*b* on the lower left side communicates with a space 59 (shown in FIGS. 3 and 4) on the side of the cylinder outer circumferential wall section 7*d* on the rearward side via the first ventilating through hole 51 and the second ventilating through hole 52 each having a tunnel shape.

Referring to FIG. 4, the flow of the cooling air around the cylinder 2 will be described below. The arrows shown in FIG. 4 indicate the flow of the cooling air.

Among the sections of the cylinder 2, the almost entire face of the cylinder outer circumferential wall section 7*b* on the lower left side, the almost rear half of the cylinder outer circumferential wall section 7*c* on the upper right side and the almost entire face of the cylinder outer circumferential wall section 7*d* on the rearward side are respectively covered with the fan shroud 40. On the side of the cylinder outer circumferential wall section 7*d* on the rearward side, cooling air from the rearward side to the forward side is formed by the cooling fan 44 and the fan shroud 40. The most part of the cooling air from the rearward side to the forward side collides with the cylinder outer circumferential wall section 7*d* on the rearward side and flows while being separated in the right and left directions along the ventilating concave sections 57 of the cylinder outer circumferential wall section 7*d* on the rearward side, thereby cooling the cylinder outer circumferential wall section 7*d* on the rearward side.

Part of the cooling air being separated in the left direction passes through the first ventilating through hole 51 and the second ventilating through hole 52 and is guided into the cutout ventilating section 50, and the portions of the cylinder outer circumferential wall section 7*b* on the lower left side, that is, the rearward thick portion up to the cylinder bore 10 and the portion of the pushrod insertion holes 63 formed on the rearward side, are cooled effectively by the cooling air. Hence, the first ventilating through hole 51 and the second ventilating through hole 52 serve as the ventilating passages for the cooling air for cooling the inner portion of the cylinder outer circumferential wall section 7*b* on the lower left side having a thickness larger than those of the other cylinder outer circumferential wall sections 7*a*, 7*c* and 7*d*, whereby the cylinder 2 and the cylinder head 3 being high in temperature can be cooled uniformly as much as possible. Furthermore, at this time, the ignition coil 15*a* (shown in FIG. 2) of the ignition unit 15 is cooled by the cooling air being separated in the left direction. The cooling air guided into the cutout ventilating section 50 joins the cooling air flowing along the ventilating concave sections 55 on the rearward side of the cylinder outer circumferential wall section 7*b* on the lower left side. The joined cooling air flows forward along the ventilating concave sections 55 on the forward side of the cylinder outer circumferential wall section 7*b* on the lower left side to cool the forward portion of the cylinder outer circumferential wall section 7*b* on the lower left side. The cooling air having cooled the cylinder outer circumferential wall section 7*b* on the lower left side cools the cylinder outer circumferential wall section 7*a* on the forward side while the cooling air flows forward.

Furthermore, on the side of the cylinder outer circumferential wall section 7*c* on the upper right side, the most part of the cooling air having collided with the cylinder outer circumferential wall section 7*d* on the rearward side and having been separated in the right direction flows forward along the ventilating concave sections 56 of the cylinder outer circumferential wall section 7*c* on the upper right side to cool the cylinder outer circumferential wall section 7*c* on the upper right side. The cooling air having cooled the cylinder outer circumferential wall section 7*c* on the upper right side cools the cylinder outer circumferential wall section 7*a* on the forward side while the cooling air flows forward.

Although the embodiment according to the present invention has been described in detail, the present invention is not limited to the above-mentioned embodiment, but can be modified in various ways. In other words, although the cylinder-inclined engine having the cylinder 2 inclined in the lower left direction with respect to the vertical direction has been described in the above-mentioned embodiment, the present invention is applicable to an engine having a cylinder 2 that is not inclined.

Moreover, as another embodiment according to the present invention, a tunnel-shaped ventilating hole extending in the front-rear direction can be formed further in the forward portion of the cylinder outer circumferential wall section 7*b* on the lower left side. More specifically, a tunnel-shaped ventilating hole extending in the front-rear direction is formed in the space portion between the pushrod insertion hole 63 for the air exhaust valve on the forward side and the cylinder bore 10 so as not to interfere with the pushrod insertion hole 63 for the air exhaust valve on the forward side, whereby the space on the side of the cylinder outer circumferential wall section 7*a* on the forward side can communicate with the cutout ventilating section 50 via the tunnel-shaped ventilating hole. As a result, part of the cooling air having been guided into the cutout ventilating section 50 flows through the tunnel-shaped ventilating hole. Hence, the cooling air effectively cools the portions of the cylinder outer circumferential wall section 7*b* on the lower left side, that is, the forward thick portion up to the cylinder bore 10 and the portion of the pushrod insertion hole 63 for the air exhaust valve formed on the forward side, thereby being capable of cooling the cylinder 2 more uniformly. The tunnel-shaped ventilating hole can be formed into a plurality of small ventilating holes disposed so as to be arranged vertically in the axial direction of the cylinder 2

As described above, the cylinder cooling apparatus for the air-cooled engine according to the present invention has the following excellent effects.

(1) The tunnel-shaped ventilating holes extending from the cylinder outer circumferential wall section on the side of the cooling fan to the cutout ventilating section are formed in the cylinder outer circumferential wall section between the pushrod insertion hole disposed on the side of the cooling fan and the cylinder bore, whereby the cooling air from the cooling fan flows into the cylinder outer circumferential wall section, the thickness of which is made large due to the formation of the pushrod insertion holes. As a result, the cooling effect by the cooling air can be exerted efficiently to the inside of the cylinder, and the cylinder and the cylinder head being high in temperature can be cooled uniformly as much as possible. In addition, since the cooling fan is not required to be made large in size, the outside dimensions of the engine is not required to be changed and the engine can be made compact.

(2) The cylinder is inclined approximately with respect to the vertical direction, whereby the total height of the engine can be suppressed low.

(3) The fuel supply apparatus (carburetor) is disposed on the side of the cooling fan, whereby the fuel supply apparatus (carburetor) can be cooled effectively by using cooling air being low in temperature and not yet used to cool the cylinder.

(4) The tunnel-shaped ventilating hole is formed further in the cylinder outer circumferential wall section on the opposite side of the cooling fan, whereby the cooling air also flows into the cylinder outer circumferential wall section on the opposite side of the cooling fan, whereby the cylinder can be cooled more uniformly.

(5) The tunnel-shaped ventilating hole is formed into a plurality of small ventilating holes, whereby the mechanical strength of the portions around the tunnel-shaped ventilating holes can be avoided from being lowered.

(6) The cooling air can cool the ignition coil disposed near the ventilating passage of the cooling air.

What is claimed is:

1. A cylinder cooling apparatus for an air-cooled engine, comprising:

a cooling fan provided on one end section of a crankshaft, a pair of pushrod insertion holes for air intake and exhaust valves formed in a cylinder outer circumferential wall section on the side approximately orthogonal to the axial direction of the crankshaft and disposed with a space provided therebetween in the axial direction of the crankshaft, a fan shroud for covering the cooling fan and for covering the cylinder outer circumferential wall section in which the pushrod insertion holes are formed, a cutout ventilating section formed in the cylinder outer circumferential wall section between the pair of pushrod insertion holes, tunnel-shaped ventilating holes formed in the cylinder outer circumferential wall section between the pushrod insertion hole disposed on the side of the cooling fan and a cylinder bore and extending from the cylinder outer circumferential wall section on the side of the cooling fan to the cutout ventilating section, and a gasket sandwiched between the cylinder and the cylinder head, wherein the cutout ventilating section and the tunnel-shaped ventilating hole are disposed on an opposite side of the gasket from the cylinder head.

2. The cylinder cooling apparatus for an air-cooled engine according to claim 1, wherein the axial center of the cylinder is inclined approximately with respect to the vertical direction.

3. The cylinder cooling apparatus for an air-cooled engine according to claim 1, wherein the pushrod insertion hole disposed on the side of the cooling fan is used for the air intake valve.

4. The cylinder cooling apparatus for an air-cooled engine according to claim 1, further comprising a tunnel-shaped ventilating hole formed in the cylinder outer circumferential wall section between the pushrod insertion hole disposed on the opposite side of the cooling fan and the cylinder bore and extending from the cutout ventilating section to the cylinder outer circumferential wall section on the opposite side of the cooling fan.

5. The cylinder cooling apparatus for an air-cooled engine according to claim 1, the tunnel-shaped ventilating hole is formed into a plurality of small ventilating holes disposed so as to be arranged in the axial direction of the cylinder.

6. A cylinder cooling apparatus for an air-cooled engine, the apparatus comprising:

a crankshaft extending in an axial direction;

a cooling fan provided on one end section of the crankshaft;

a cylinder having a cylinder bore and an outer circumferential wall;

a cylinder head connected to a top surface of the cylinder;

a pair of pushrod insertion holes for air intake and exhaust valves, the pushrod insertion holes being spaced apart in the axial direction of the crankshaft and being disposed in the outer circumferential wall of the cylinder;

a fan shroud covering the cooling fan;

a cutout ventilating section formed in the outer circumferential wall of the cylinder and located between the pair of pushrod insertion holes;

a tunnel-shaped ventilating hole formed in the outer circumferential wall of the cylinder and disposed between one of the pair of pushrod insertion holes closest to the fan and the cylinder bore, the tunnel-shaped ventilating hole extending from the outer circumferential wall on the side of the cooling fan to the cutout ventilating section; and a gasket sandwiched between the cylinder and the cylinder head, wherein the cutout ventilating section and the tunnel-shaped ventilating hole are disposed on an opposite side of the gasket from the cylinder head.

7. The apparatus of claim 6, wherein the outer circumferential wall of the cylinder includes a first side wall and a second side wall, the first side wall being closest to the fan and substantially orthogonal to the axial direction of the crank shaft, and the second side wall is transverse to the first side wall, wherein the cutout ventilating section is a cutout in the second side wall, wherein the ventilating hole has an inlet in the first side wall and an outlet in the cutout ventilating section.

8. An air-cooled engine comprising:

the apparatus of claim 6;

a piston disposed in the cylinder bore;

pushrods disposed in the pushrod insertion holes; and air intake and exhaust valves operably connected to the pushrods.

9. The apparatus of claim 6, further comprising a concave ventilating section formed in the outer circumferential wall of the cylinder on a side of the cylinder opposite to the pushrod insertion holes.

10. The apparatus of claim 6, wherein the outer circumferential wall of the cylinder includes a first side wall, a second side wall, and a third side wall, wherein the first side wall is closest to the fan and substantially orthogonal to the axial direction of the crank shaft, and the third side wall and the second side wall are transverse to the first side wall, wherein the cutout ventilating section is a cutout in the second side wall, wherein the ventilating hole has an inlet in the first side wall and an outlet in the cutout ventilating section, and wherein a concave ventilating section is formed in the outer circumferential wall of the cylinder on a side of the cylinder opposite to the pushrod insertion holes.

11. The apparatus of claim 10, wherein the tunnel-shaped ventilating hole and the concave ventilating section extend along the cylinder in a direction substantially parallel to the axial direction of the crankshaft.

12. An air-cooled engine comprising:

the apparatus of claim 11;

a piston disposed in the cylinder bore;

pushrods disposed in the pushrod insertion holes; and air intake and exhaust valves operably connected to the pushrods.

13. The apparatus of claim 10, wherein the cutout ventilating section is disposed between pushrod insertion holes in the axial direction of the crankshaft.

14. The apparatus of claim 6, wherein the cutout ventilating section is disposed between pushrod insertion holes in the axial direction of the crankshaft.

* * * * *